US005133156A

United States Patent [19]

Arms et al.

[11] Patent Number: 5,133,156

[45] Date of Patent: Jul. 28, 1992

[54] ADJUSTABLE BELT SANDER FOR WOOD

[75] Inventors: Thomas H. Arms, Shelton; Joseph G. Kovaleski, Wilton, both of Conn.

[73] Assignee: Penn Keystone Corporation, Wallingford, Conn.

[21] Appl. No.: 512,135

[22] Filed: Apr. 19, 1990

[51] Int. Cl.[5] ..... B24B 21/00; B24B 21/20

[52] U.S. Cl. ..... 51/141; 51/135 R; 51/137; 51/143; 51/148; 51/240 A; 51/135 BT

[58] Field of Search ..... 51/135 R, 135 BT, 137, 51/138, 139, 141, 142, 143, 144, 145 R, 145 T, 146, 147, 148, 121, 122, 125, 125.5, 126, 216 A, 216 ND, 216 H; 51/240 R, 240 A; 144/285, 286 R, 286 A, 287; 474/47, 48, 49

[56] References Cited

U.S. PATENT DOCUMENTS

| | | | |
|---|---|---|---|
| 778,187 | 12/1904 | Gray | 474/47 |
| 1,286,560 | 12/1918 | Docter, Sr | 51/135 R |
| 1,395,884 | 11/1921 | West | 474/47 |
| 1,659,578 | 2/1928 | Schmidt et al. | 474/47 |
| 1,770,948 | 7/1930 | Schmidt | 474/47 |
| 2,229,466 | 1/1941 | Mattison | 51/135 R |
| 2,407,939 | 9/1946 | Steinhilber | 51/135 R |
| 2,538,044 | 1/1951 | Ruehle . | |
| 2,640,303 | 6/1953 | Johnson . | |
| 2,857,717 | 10/1958 | Edgemond et al. . | |
| 3,280,513 | 10/1966 | Fuchs | 51/148 |
| 3,535,827 | 10/1970 | Oltra | 51/135 R |
| 3,713,255 | 1/1973 | Welsch . | |
| 3,760,538 | 9/1973 | Solheim | 51/148 |
| 4,114,665 | 9/1978 | Decker | 144/285 X |
| 4,152,948 | 5/1979 | LiDonnici | 474/47 |
| 4,201,254 | 5/1980 | Fehric . | |
| 4,231,193 | 10/1980 | Siegel | 51/148 X |
| 4,257,195 | 3/1981 | Appelgren | 51/238 R X |
| 4,259,814 | 4/1981 | Glaser et al. | 51/122 |
| 4,316,349 | 2/1982 | Nelson | 51/148 X |
| 4,373,299 | 2/1983 | Gaston et al. | 51/122 |
| 4,443,977 | 4/1984 | Gainai . | |
| 4,578,906 | 4/1986 | Appleton . | |
| 4,603,510 | 8/1986 | Rasmussen | 51/48 |
| 4,617,763 | 10/1986 | Edling | 51/148 X |
| 4,926,602 | 5/1990 | Crouch | 51/240 A X |
| 4,939,870 | 7/1990 | Wang | 51/135 R |

FOREIGN PATENT DOCUMENTS 936617 12/1955 Fed. Rep. of Germany .

*Primary Examiner*—Bruce M. Kisliuk
*Assistant Examiner*—John A. Marlott
*Attorney, Agent, or Firm*—Bachman & LaPointe

[57] ABSTRACT

A belt sander is described which comprises a support structure, a motor driven pulley secured to the support structure, a primary pulley secured to the support structure spaced from the motor driven pulley, an optional secondary pulley which can be installed over the primary pulley, and an endless belt, having an abrasive material along one face contacting the wood to be shaped, traveling about the pulleys. The sander further includes a belt tracking adjustment system, a work table adjustable relative to the endless belt and a dust guard having an aperture for allowing a vacuum system to be connected thereto.

20 Claims, 4 Drawing Sheets

ADJUSTABLE BELT SANDER FOR WOOD

BACKGROUND OF THE INVENTION

The present invention relates to belt sanders and particularly to belt sanders which are adapted to be used in wood working operations.

Many wood working projects call for odd shapes of wood to be cut out. Such pieces of wood often have compound curves, inside and outside radii and transitions between lines and curves. Such shapes are often necessary to the function, or are to add a decorative touch to the project.

After cutting a board into the approximate desired shape, a woodworker must sand the board to final shape and finish. The faces of the pieces are readily sandable with many sanding devices on the market. The bigger problem lies in sanding the edges.

Drum type sanders do a good job at sanding without much effort. Their principal drawback however is that a woodworker must maintain an inventory of various size drums and sand paper sleeves for each drum size. The sand paper sleeves are expensive and wear out quickly. A further hindrance is that when the drum sizes are changed, the tool or motor which drives the sanding drum may not be able to vary its speed (r.p.m.) easily or accurately if at all. This is important because the quality and ease of sanding is dependent upon the surface feet per minute at which the sand paper contacts the work piece.

Belt sanders do well on straight edges and on larger outside curves. Most belt sanders present the sanding belt on a vertical plane perpendicular to the face of the board. The sanding belt passes over a flat surface in the area where the grit contacts the workpiece. This arrangement makes it difficult to sand inside a concave radius. The following U.S. Patents illustrate some of the belt sanders and grinding tools known in the art.

U.S. Pat. No 2,538,044 to Ruehle illustrates a belt sander attachment for a power tool. The attachment has a spindle adapted to be inserted in and gripped by a chuck. The spindle fits within a sanding belt head drum. A set screw is used to insure that the spindle and head drum rotate together. The attachment further comprises an adjustable tail drum assembly. The axes of the drum heads may be changed to adjust for uneven belts.

U.S. Pat. No. 2,640,303 to Johnson exemplifies an endless belt knife sharpening and grinding attachment. The grinder has vertically disposed pulleys with a belt having a grinding outer surface trained over the pulleys. The pulleys are rotated by a motor carried by the base. Tension in the grinding belt is maintained by a spring member.

U.S. Pat. No. 2,857,717 to Edgemond, Jr. et al. illustrates a belt sander having a base and a frame assembly for supporting a pair of pulleys over which a sanding belt is positioned. The frame assembly is pivotally mounted on the frame for movement between a number of positions. The sander further includes a table assembly which moves relative to the belt and which can act either as a fence or a table.

U.S. Pat. No. 4,201,254 to Fehric relates to a woodworking structure capable of performing a number of different operations such as cutting and grinding. The structure includes a pivotable motor and pulley attachments for accommodating an endless grinding or sanding belt. The pulley attachments include belt support members attached to the work table. The support members and the belt are driven by the motor and a pair of pulleys attached to the motor and one of the support members.

U.S. Pat. Nos. 4,578,906 to Appleton and 3,713,255 to Welsch illustrate hand-held grinding tools. In the Appleton tool, the idler pulley may be replaced only by replacing the entire arm assembly. In the Welsch tool, the support assembly may be disassembled to replace the pulley.

U.S. Pat. No. 4,443,977 to Gaiani illustrates a grinding tool for machining skew surfaces. The tool has a series of adjustable shaping rollers to machine the skew surface. The position of each roller is controlled individually to form the desired curved configuration.

One of the problems associated with belt sanders is that a woodworker is limited by the diameter of the pulley under the sanding belt. Additionally, most belt sanders present the belt vertically making it very difficult to hold and maneuver the workpiece.

Accordingly, it is a principal object of the present invention to provide an improved belt sander that enables a woodworker to form wood articles having compound curves, inside and outside radii, and transitions between lines and curves.

It is a further object of the present invention to provide a belt sander as above having a number of different diameter pulleys which can be quickly replaced without the use of tools.

It is yet a further object of the present invention to provide a belt sander as above having an adjustable work table to bevel an edge, chamfer or add a decorative edge.

It is still a further object of the present invention to provide a belt sander having improved belt tracking.

Still further objects and advantages will become more apparent from the following descriptions and drawings wherein like reference numerals depict like elements.

SUMMARY OF THE INVENTION

The foregoing objects are achieved by a belt sander comprising a support structure, a motor driven pulley secured to the support structure, a primary pulley secured to the support structure spaced from the motor driven pulley and having means for allowing a secondary pulley to be installed over the primary pulley and secured thereto, and an endless belt, having an abrasive material along one face contacting the wood to be shaped, traveling about the pulleys. The sander further includes means for adjusting the tracking of the belt and for facilitating removal of the belt and means for tensioning the endless belt. Still further, the sander includes a work table adjustable relative to the endless belt and a dust guard having means for allowing a vacuum system to be connected thereto.

In a first embodiment of the present invention, the belt tracking adjustment means and belt removal means comprises a motor driven pulley connected to a pivotable motor. In a second embodiment, the belt tracking adjustment means and belt removal means comprises a pivotably movable primary pulley One of the principal advantages of the present invention is that a number of secondary pulleys having different diameters may be installed over the primary pulley to form curves with different radii. Still another advantage is that these secondary pulleys may be installed without the use of tools. Still further, the adjustable work table allows a woodworker to bevel an edge, chamfer, or add a decorative edge.

. 9 illustrates the mechanism for adjusting the position of the work table; and

Figure 10:
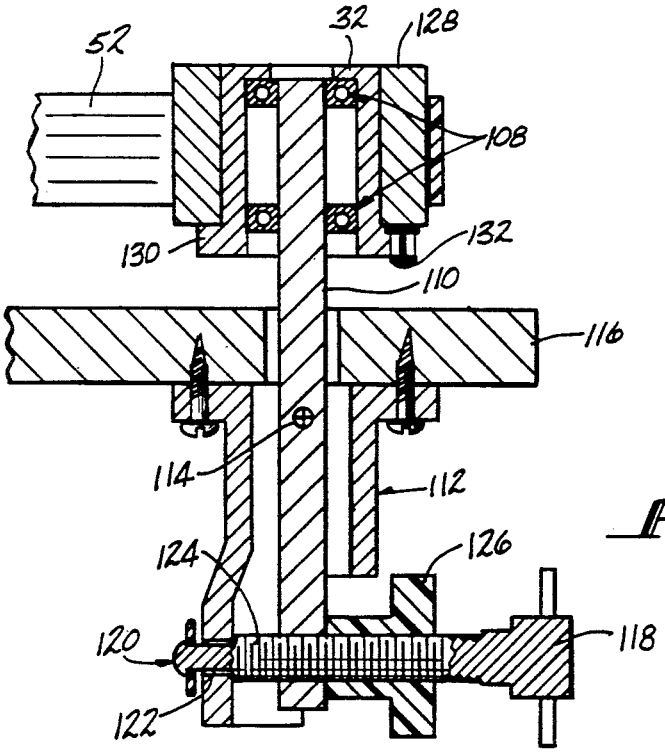

FIG. 10 illustrates a second embodiment of the present invention wherein the primary pulley is pivotably mounted to the support structure.

DETAILED DESCRIPTION

Referring now to the drawings, the belt sander 10 of the present invention includes a base support structure 12 including side walls 14 and 16, rear wall 18, top plate 20, and lower movable plate 22. The belt sander further includes a motor assembly 24 having a shaft 26 which extends through a slot 28 in the top plate 20, a drive pulley 30 mounted on the shaft 26, a primary pulley 32 and an adjustable work table 34 secured to the support structure 12.

The side walls 14 and 16 and the rear wall 18 may be formed from any suitable material known in the art. Typically, they would be formed from either a metal, metal alloy or a high strength plastic. If desired, each wall may have an integral flange 11 with holes for allowing the sander 10 to be mounted to a table or the like.

The motor assembly 24 may comprise any conventional motor known in the art such as a capacitive start motor. Unlike other belt sander systems, the motor 24 need not be a variable speed motor.

The motor 24 is pivotably mounted on the rear wall 18 by a hinge 36. Its position is adjusted by a plate 38 secured to the motor's frame, a trunion 40 having a threaded bore 42 slidably received within a pair of captivating collars 44 and a manually operated shaft 46 having a threaded end 48 which is received in the bore 42. The shaft 46 may be mounted to one of the side walls 14 and 16 by a bracket 49. If desired, the shaft 46 may be arranged so as to pass through an opening in the back wall 18 of the support structure 12. Additionally, a compression spring 47 may be provided to take up play. Rotation of the handle 50 on the shaft 46 causes the plate 38 to move along the shaft 46 and rotate the motor 24 about the substantially horizontal pivot axis defined by the hinge 36.

Tilting the motor in this manner has been found to be desirable for a number of reasons. First, it allows an operator of the sander to adjust belt tracking as needed. When the motor 24 is tilted, the position of the drive pulley 30 is changed causing the belt to have a different tracking about the pulleys Tilting of the motor and the attached drive pulley also allows the belt 52 to be more easily replaced. Still further, it allows the use of heavier bearings with the primary pulley and allows the primary pulley to remain substantially perpendicular to the work table 34 while the belt tracking is adjusted.

Figure 1:
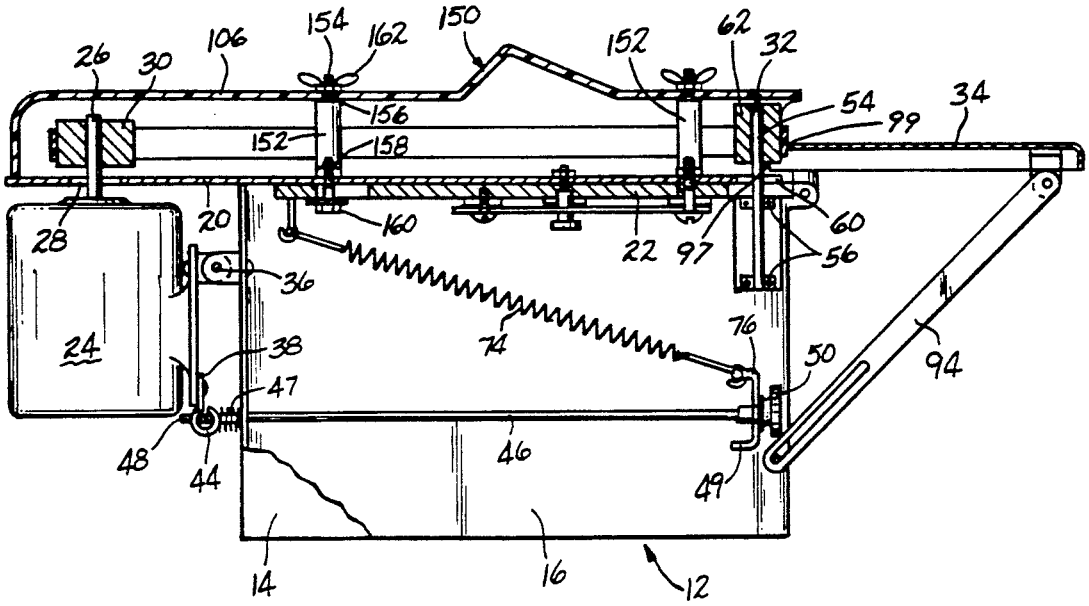
FIG. 1 is a side view in partial cross section of the belt sander of the present invention.
Figure 2:
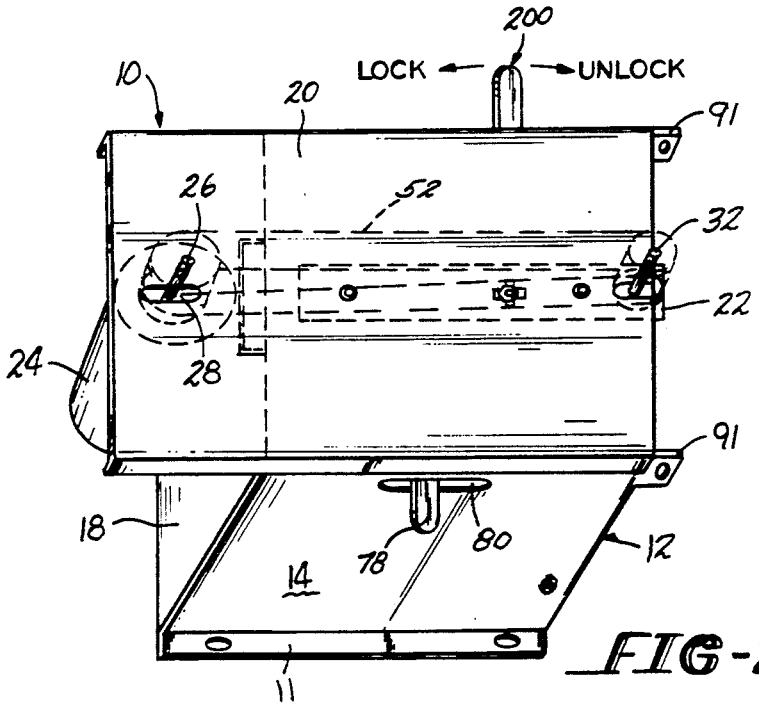
FIG. 2 is a perspective view looking downward of the belt sander of FIG. 1 without the work table.

As shown in FIGS. 1 and 2, the belt 52 (shown in dotted lines in FIG. 2) travels about the drive pulley 30 and the primary pulley 32. The belt 52 has an abrasive material along the face 53. The primary pulley 32 preferably comprises a substantially cylindrical member 54 supported by bearings 56 within housing 58 attached to the movable plate 22. The member extends through an elongated slot 60 in the top plate 20.

The primary pulley 32 may have any desired outer diameter. Generally, the diameter will be about one-half inch.

Figure 5:
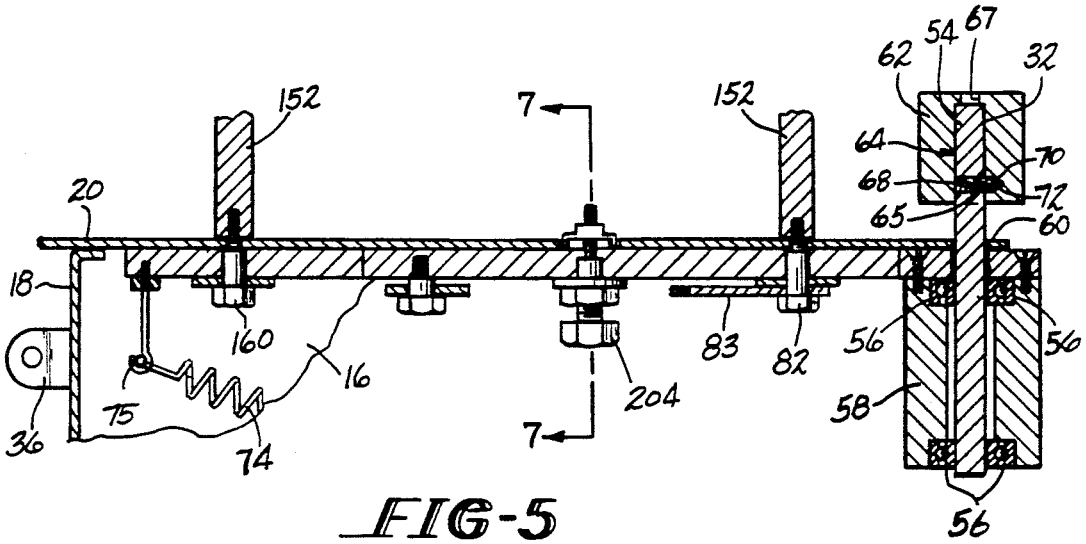
FIG. 5 is a cross-sectional side view of a portion of the belt sander illustrating the manner in which the primary pulley is supported.

In accordance with the present invention, the sanding radii may be altered by placing a secondary pulley 62 over the primary pulley As shown in FIG. 5, the secondary pulley 62 preferably comprises a hollow cylindrical member having a central bore 64 whose diameter is substantially equal to the outer diameter of the primary pulley. The bore 64 may have an upper lip 67 if desired to insure proper seating on the primary pulley 32. Of course, the secondary pulley 62 may have any desired outer diameter. Typically, its outer diameter will be from about one-half inch to about three inches.

To secure the secondary pulley 62 in place, the primary pulley has a ball spring plunger 65 positioned within a threaded bore 68. The ball spring plunger 65 may be any suitable plunger known in the art such as that sold under the trademark VLIER. The secondary pulley 62 has a notch 70 within the central bore 64 for receiving the ball element 72 of the plunger It has been found that this construction enables the secondary pulley to be easily snapped on and removed.

Figure 6:
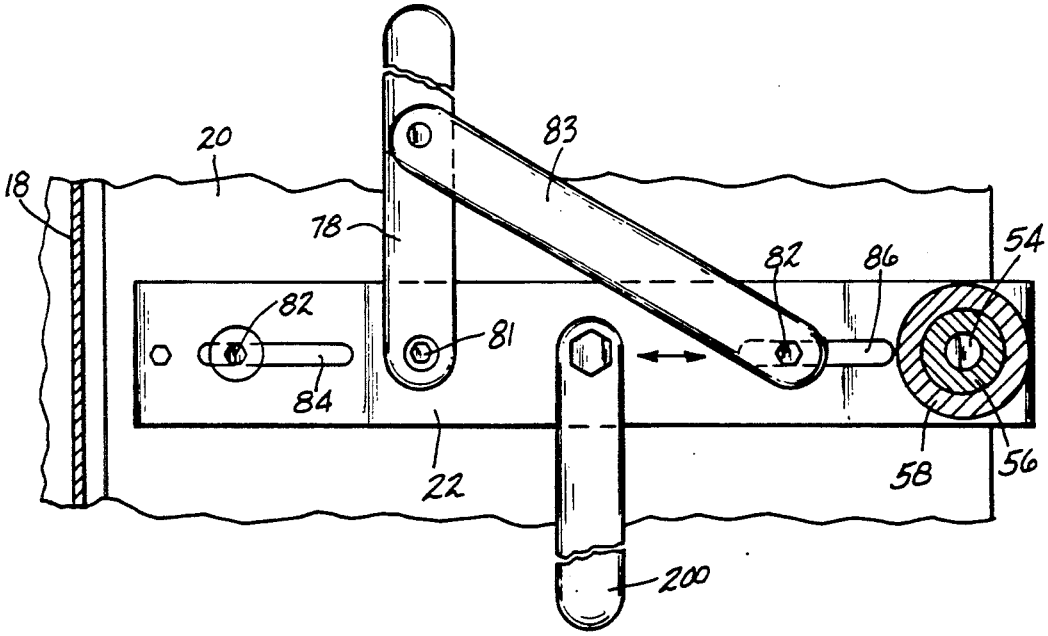
FIG. 6 illustrates the manual device for adjusting the position of the moving plate.

As previously noted the primary pulley 32 is secured to the lower movable plate 22. As shown in FIG. 6, the plate 22 moves or slides in an axial direction. Guide pins 82 are provided to define and limit the extent of the plate movement Each guide pin is preferably formed by a shoulder screw in threaded engagement with the top plate 20 and passes through an elongated slot 84 or 86 in the plate 22.

Figure 7:
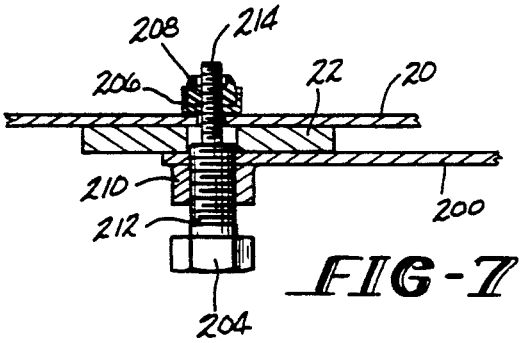
FIG. 7 is a cross-sectional view of the locking lever mechanism taken along line 7—7 of FIG. 5.

Proper tensioning of the belt 52 is achieved by securing two spring elements 74 between a rear portion of the lower movable plate 22 and a support bar 76 extending between the side walls 14 and 16. As shown in FIG. 5, each spring 74 may be connected to the plate 22 by an eyebolt 75. When it is necessary to remove the belt 52, the position of the plate 22 and thus the primary pulley 32 may be changed by the tension relief lever 78 extending through a slot 80 in one of the side walls. As shown in FIGS. 6 and 7, the lever 78 is fastened to the bottom surface of the moving plate 22 by a guide pin 81. The lever 78 is also fastened to one of the guide pins 81 by a link 83. Movement of the lever 78 causes movement of the plate 22. As the plate 22 moves rearwardly, the belt 52 becomes slackened and easy to remove. After the used belt has been replaced by a new belt, lever 78 is operated to move the plate 22 into a position where the springs 74 assert a tensioning effect on the new belt 52.

If desired, a mechanism may be provided to prevent vibrations transmitted through the moving plate 22 from causing poor belt tracking. This mechanism may consist of a locking handle 200 and a locking mechanism 202 therefor. The locking handle 200 preferably extends along the underside of the moving plate 22 and through a slot (not shown) in a side wall 14 or 16 of the base support structure The locking mechanism 202 consists of a special double threaded screw 204, a nut cage 206 secured to the top plate 20, and an elastic stop nut 208.

Figure 8:
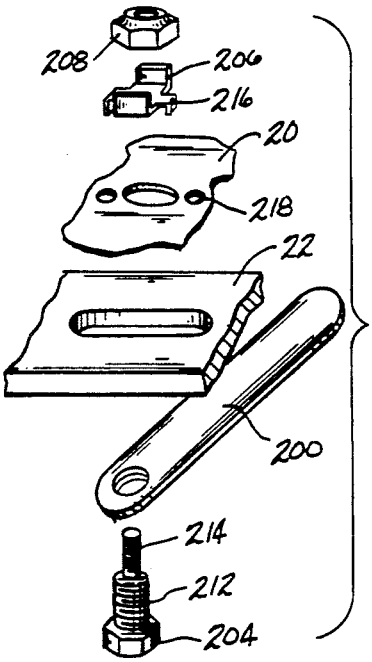
FIG. 8 is an exploded view of the locking lever mechanism of FIG. 7; FIG

As shown in FIGS. 7 and 8, the handle 200 has a nut or boss 210 brazed to its lower surface The nut or boss 210 is threaded so as to receive coarse threads 212 on the screw 204. The screw 210 and its fine thread 214 extend through openings in the plates 20 and 22 and the nut cage 206. The thread 214 engages the threaded bore in the stop nut 208.

Rotation of the handle 200 about screw 204 in a first direction causes the handle 200 to move against the moving plate 22. The resulting clamping action between the handle 200 and plate 20 restricts movement of the plate 22 and dampens the transmission of harmful vibrations. If it becomes necessary to move the plate 22, the handle 200 is rotated in the opposite direction to loosen the screw 204.

It should be noted that the nut cage 206 may be secured to top plate 20 in any desired manner. For example, the nut cage 206 may have tabs 216 which pass through slots 218 in the plate 20 and which are then bent to hold the cage in position.

Figure 3:
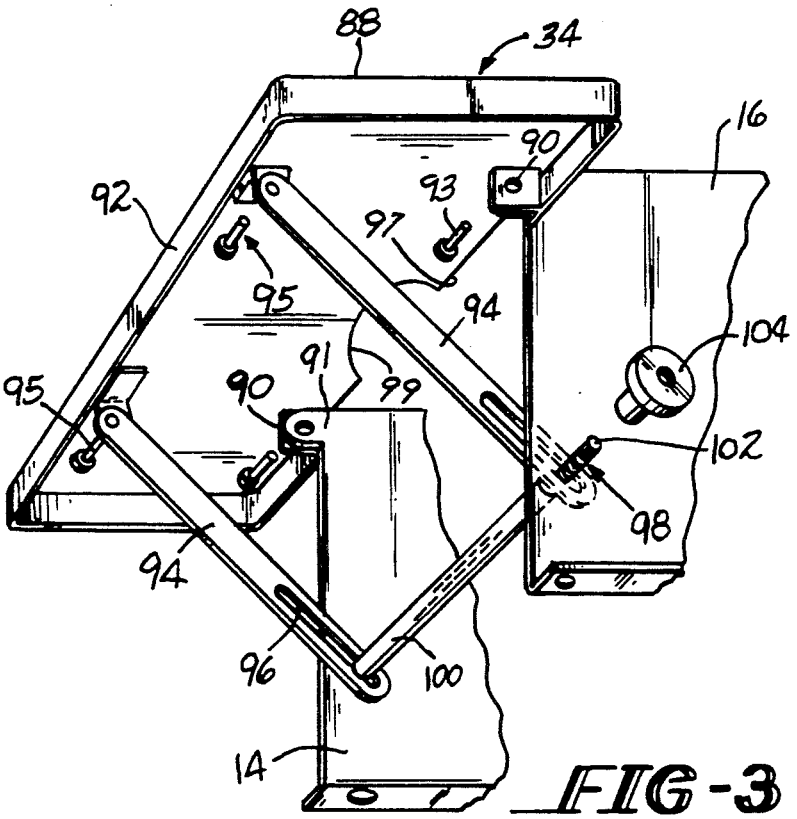
FIG. 3 illustrates the adjustable work table attachment for the belt sander.
Figure 4:
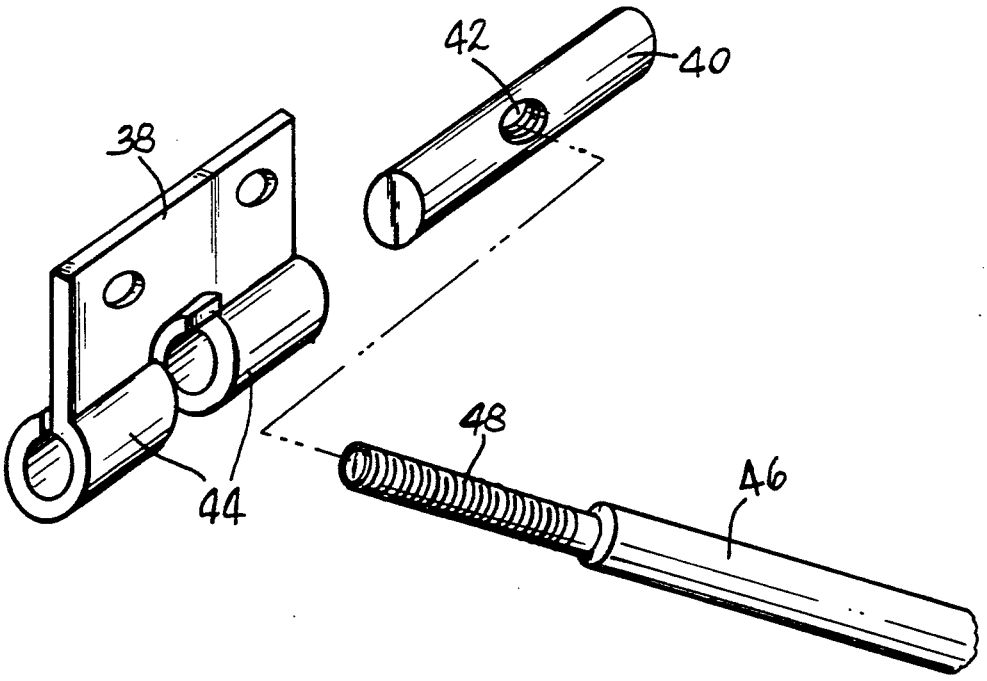
FIG. 4 is an exploded view of the manual device for adjusting the position of the belt sander motor.

As shown in FIG. 3, the pivotable work table 34 is formed by a plate member 88 secured to the side walls 14 and 16 by brackets 90 and 91 and pins 93. The work table is movable between a substantially 90° angle from a first position where the table's upper surface 92 is substantially perpendicular to the belt 52 to a second position where the top surface 92 is substantially parallel to the belt. As shown in FIG. 3, the plate member 88 has an edge 97 with a notch 99. As shown in FIG. 1, the edge 97, when the work table is in its first position, is located adjacent the primary and/or secondary pulleys 32 and 62 and extends substantially perpendicular to the axis of rotation of the primary pulley.

Figure 9:
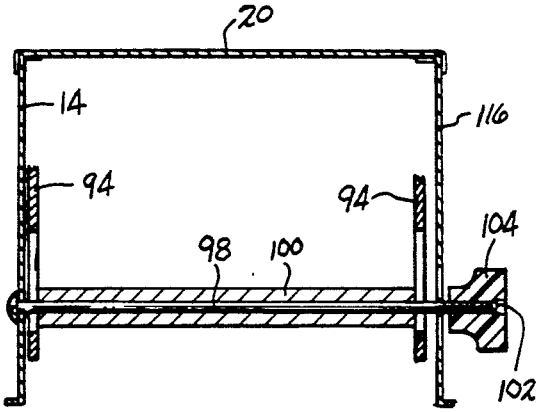

Adjustment of the work table position is achieved in the following manner. Spaced apart links 94 are secured to the lower surface of the plate member 88 using any conventional pin and bracket arrangement 95 known in the art. Each link has an elongated slot 96 along its lower edge. A rod 98 secured to at least one of the side walls extends through the slots 96. A metal tube or sleeve 100 surrounds the rod 98 in the region between the links 94. As shown in FIG. 9, the rod 98 has a threaded end portion 102 which extends through an opening in one of the side walls and which engages a manual locking member 104. By loosening the manual locking member 104, the links 94 are free to move relative to the rod 98. This allows pivotable movement of the table 34. When the table 34 has been moved to a desired position, it is locked in place by rotating the locking member 104 until it pinches the links and metal tube between the two side walls and causes the links to be held in position against the metal tube or sleeve 100.

As shown in FIG. 1, a dust cover 106 may be placed over a portion of the endless belt 52. The dust cover 106 may be provided with a port 150 to which a vacuum system may be connected to remove dust collected beneath the cover. The dust cover 106 may be secured to the top plate 20 by threaded standoff guards 152. Each guard has a threaded end portion 154 which passes through an opening 156 in the dust guard and threaded bore 158 at its opposite end. Each standoff guard is held in position by a screw 160 engaging the bore 158 and a wing nut 162 engaging the threaded portion 154.

It has been found that the belt sander of the present invention provides many benefits. Primarily, it allows a wood worker to form wooden articles having curvatures with different radii unlike other commercially sold belt sanders. The shaping curvature is altered by merely using bigger or smaller belt driven pulley members. It has been found that the change in pulley diameters permitted by the present invention does not affect the surface feed per minute rate. In fact, the surface feed per minute rate remains substantially constant in the belt sander of the present invention. This is because the belt speed is controlled solely by the motor driven pulley It has also been found that the belt sander of the present invention provides improved belt tracking. This is highly desirable since every belt is different and tracking must be adjusted. The tilting mechanism employed in the present invention to adjust belt tracking allows the belt to run true.

It should be noted that the primary and secondary pulleys may be formed from any suitable metal or metal alloy known in the art. For example they may be formed from aluminum, copper, iron, alloys thereof, brass, diecast zinc, and diecast aluminum.

An alternative embodiment of the belt sander of the present invention is illustrated in FIG. 10. In this embodiment, it is the primary pulley which may be tilted to adjust belt tracking. As shown therein, the primary pulley is supported by ball bearings 108 and arbor 110. The arbor 110 is secured to an adjuster housing 112 by a pivot pin 114. The adjuster housing in turn is secured to the underside of plate member 116 which can be the movable plate in this arrangement. Any suitable means known in the art may be used to secure the adjuster housing 112 to the plate member 116.

To adjust the position of the primary pulley 32, an adjustment screw 118 is provided. As shown in FIG. 10, the adjustment screw has a staked outer end 120 which passes through an aperture 122 in the housing 112. The screw 118 has a threaded portion which engages a threaded bore 124 in a lower end of the arbor 110. A lock nut 126 is provided to secure the arbor and turn the primary pulley in a desired position.

To change the position of the primary pulley 32, the adjustment screw 118 is rotated so that the arbor and the pulley 32 rotate about the axis formed by the pivot pin 114.

FIG. 10 also illustrates an alternative embodiment for positioning a secondary pulley 128 on the primary pulley 32. As shown therein, the primary pulley 32 has an integral flange member 130 extending about its lower periphery. This flange member forms a seat upon which the secondary pulley 128 may be seated. In this embodiment, the secondary pulley may be held in place by the frictional engagement between the outer surface of the primary pulley and the inner surface of the secondary pulley. Alternatively, a slot (not shown) may be provided in the flange member 130 and a rivet 132 may be provided for engaging this slot to secure the pulleys together. Such ar arrangement allows the two pulleys to turn and act as one unit when driven by the belt 52.

It is apparent that there has been provided in accordance with this invention a wood sander which fully satisfies the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

What is claimed:

1. A sander for shaping a piece of wood to a desired configuration which comprises:

a support structure having a pair of spaced apart sidewalls;

a motor driven pulley secured to said support structure;

a primary pulley secured to said support structure, said primary pulley being spaced from said motor driven pulley along a first axis and having means for allowing a secondary pulley to be installed over said primary pulley and secured thereto;

an endless belt having an abrasive material along one face contacting said wood to be shaped, said endless belt traveling about said motor driven pulley and said primary pulley;

an adjustable work table for allowing a woodworker to chamfer, bevel an edge of, or add a decorative edge to said piece of wood, said work table being movable through a range of substantially 90°;

said work table being formed by a plate member having a top surface and an edge surface, said edge surface being located adjacent said primary pulley and extending substantially perpendicular to an axis of rotation of said primary pulley when said work table is in a first position whereat said top surface of said plate member is substantially perpendicular to said one face of said endless belt;

said plate member being secured to said sidewalls of said support structure and being movable between said first position and a second position whereat said top surface of said plate member is substantially parallel to said one face;

means for locking said work table in said first position, said second position and positions intermediate said first and second positions; and said support structure including a stationary top plate and a lower plate movable relative to said stationary top plate.

2. A sander according to claim 1 further comprising:

said primary pulley being formed by a substantially cylindrical member having a desired outer diameter;

said secondary pulley being formed by a cylindrical member having a central bore with a diameter substantially equal to said primary pulley outer diameter; and said secondary pulley surrounding a portion of said primary pulley in its installed position.

3. A sander according to claim 2 wherein:

said secondary pulley has a notch in a wall of said central bore; and said means for allowing a secondary pulley to be installed comprises a ball spring plunger which engages said notch so as to allow said secondary pulley to be easily snapped on and removed.

4. A sander according to claim 2 wherein said secondary pulley has an outer diameter in the range of from about ½" to about 3".

5. A sander according to claim 1 further comprising:

a motor for driving said motor driven pulley; and said motor being pivotably secured to a rear portion of said support structure so as to allow pivoting of said motor driven pulley relative to said primary pulley to adjust tracking of said belt and to facilitate replacement of said belt.

6. A sander according to claim 5 further comprising:

a hinge for pivotably mounting said motor to said support structure;

a plate mounted to said motor; and manual actuating means engaging said plate for causing the pivotal movement of said motor.

7. A sander according to claim 1 further comprising means for pivoting said primary pulley about a substantially horizontal axis for allowing adjustment of said belt tracking.

8. A sander according to claim 1 wherein one of said motor driven pulley and said primary pulley is movable with respect to the other to facilitate removal and replacement of said belt and to provide improved tracking.

9. A sander according to claim 1 further comprising:

said primary pulley being mounted to said movable plate by a housing containing bearings for allowing rotation of said primary pulley and said secondary pulley passing through an elongated slot in said top plate.

10. A sander according to claim 1 further including dust guard over a portion of said endless belt, said dust guard having a port for allowing a vacuum system to be connected thereto.

11. A sander according to claim 1 wherein said edge surface has a notch therein.

12. A sander according to claim 1 wherein said edge surface is substantially perpendicular to said first axis when said plate member is in either of said first and second positions.

13. A sander for shaping wood to a desired configuration which comprises:

a support structure;

a motor driven pulley secured to said support structure;

a primary pulley secured to said support structure, said primary pulley being spaced from said motor driven pulley and having means for allowing a secondary pulley to be installed over said primary pulley and secured thereto;

an endless belt having abrasive material along one face contacting said wood to be shaped, said endless belt traveling about said motor driven pulley and said primary pulley;

said support structure including a stationary top plate and a lower plate movable relative to said top plate; and spring means for tensioning said endless belt, said spring means being secured at one end to a support bar forming part of said support structure and at a second end to a rear portion of said movable lower plate.

14. A sander according to claim 13 further comprising lever means for causing movement of said movable plate relative to said top plate.

15. A sander according to claim 13 further comprising a work surface plate adjustable relative to said endless belt.

16. A sander according to claim 15 wherein said work surface plate is movable between a first position substantially perpendicular to said belt and a second position at about a 90° angle relative to said first position.

17. A sander for shaping wood to a desired configuration which comprises:

a support structure;

a motor driven pulley secured to said support structure;

a primary pulley secured to said support structure, said primary pulley being spaced from said motor driven pulley and having means for allowing a secondary pulley to be installed over said primary pulley and secured thereto;

an endless belt having abrasive material along one face contacting said wood to be shaped, said endless belt traveling about said motor driven pulley and said primary pulley;

means for pivoting said primary pulley about an axis to allow adjustments to the tracking of said belt;

an arbor for supporting said primary pulley;

said arbor being secured to a housing by a pivot pin defining said axis; and said pivoting means being formed by a threaded bore in said arbor and a manually actuated adjustment screw engaging said threaded bore, whereby rotation of said screw causes the arbor and the primary pulley to rotate about said axis formed by said pivot pin.

18. A sander for shaping a piece of wood to a desired configuration which comprises:

a support structure having a pair of spaced apart sidewalls;

a motor driven pulley secured to said support structure;

a primary pulley secured to said support structure, said primary pulley being spaced from said motor driven pulley along a first axis and having means for allowing a secondary pulley to be installed over said primary pulley and secured thereto;

an endless belt having an abrasive material along one face contacting said wood to be shaped, said endless belt traveling about said motor driven pulley and said primary pulley;

an adjustable work table for allowing a woodworker to chamfer, bevel and edge of, or add a decorative edge to said piece of wood, said work table being movable through a range of substantially 90°;

said work table being formed by a plate member having a top surface and an edge surface, said edge surface being located adjacent said primary pulley and extending substantially perpendicular to an axis of rotation of said primary pulley when said work table is in a first position whereat said top surface of said plate member is substantially perpendicular to said one face of said endless belt;

said plate member being secured to said sidewalls of said support structure and being movable between said first position and a second position whereat said top surface of said plate member is substantially parallel to said one face;

means for locking said work table in said first position, said second position and positions intermediate said first and second positions;

said primary pulley comprising a substantially cylindrical member having a desired outer diameter and an integral flange portion; and said secondary pulley comprising a hollow cylindrical member whose lower edge rests on said flange portion in the second pulley installed position.

19. A sander for shaping a piece of wood to a desired configuration which comprises:

a support structure having a pair of spaced apart sidewalls;

a motor driven pulley secured to said support structure;

a primary pulley secured to said support structure, said primary pulley being spaced from said motor driven pulley along a first axis and having means for allowing a secondary pulley to be installed over said primary pulley and secured thereto;

an endless belt having an abrasive material along one face contacting said wood to be shaped, said endless belt traveling about said motor driven pulley and said primary pulley;

an adjustable work table for allowing a woodworker to chamfer, bevel an edge of, or add a decorative edge to said piece of wood, said work table being movable through a range of substantially 90°;

said work table being formed by a plate member having a top surface and an edge surface, said edge surface being located adjacent said primary pulley and extending substantially perpendicular to an axis of rotation of said primary pulley when said work table is in a first position whereat said top surface of said plate member is substantially perpendicular to said one face of said endless belt;

said plate member being secured to said sidewalls of said support structure and being movable between said first position and a second position whereat said top surface of said plate member is substantially parallel to said one face;

means for locking said work table in said first position, said second position and positions intermediate said first and second positions;

means to adjusting the position of said plate member relative to said one face endless belt;

said adjusting means including two spaced apart links attached to said plate member with each link having an elongated slot; and a rod member secured to said support structure passing through the slot in each link.

20. A sander for shaping wood to a desired configuration which comprises:

a support structure;

a motor driven pulley secured to said support structure;

a primary pulley secured to said support structure, said primary pulley being spaced from said motor driven pulley and having means for allowing a secondary pulley to be installed over said primary pulley and secured thereto;

an endless belt having abrasive material along one face contacting said wood to be shaped, said endless belt traveling about said motor driven pulley and said primary pulley;

said primary pulley being formed by a substantially cylindrical member having a desired outer diameter;

said secondary pulley being formed by a substantially cylindrical member having a central bore with a diameter substantially equal to said primary pulley outer diameter;

said secondary pulley surrounding a portion of said primary pulley in its installed position; and a work table connected to said support structure and movable between a first position wherein a working surface of said table is substantially perpendicular to said one face of said belt and a second position wherein said working surface of said table is substantially parallel to said one face.

* * * * *

UNITED STATES PATENT AND TRADEMARK OFFICE

CERTIFICATE OF CORRECTION

PATENT NO. : 5,133,156

DATED : JULY 28, 1992

INVENTOR(S) : THOMAS H. ARMS ET AL.

It is certified that error appears in the above-identified patent and that said Letters Patent is hereby corrected as shown below:

IN COLUMN 2, LINE 62, INSERT A --.-- AFTER "PULLEY".

IN COLUMN 3, LINE 21, DELETE "FIG".

IN COLUMN 3, LINE 22, INSERT --FIG-- IN FRONT OF ". 9".

IN COLUMN 4, LINE 1, INSERT A --.-- AFTER "PULLEY".

IN COLUMN 4, LINE 13, INSERT --54-- BETWEEN "MEMBER" AND "EXTEND".

IN COLUMN 4, LINE 35, INSERT A --.-- AFTER "PLUNGER".

IN COLUMN 4, LINE 42, INSERT A --.-- AFTER "MOVEMENT".

IN COLUMN 5, LINE 3, INSERT A --.-- AFTER "STRUCTURE".

IN COLUMN 5, LINE 7, INSERT A --.-- AFTER "SURFACE".

IN COLUMN 6, LINE 14, INSERT A --.-- AFTER "PULLEY".

IN COLUMN 6, LINE 61, DELETE "A" AND INSERT --AN-- IN ITS PLACE.

IN COLUMN 10, CLAIM 19, LINE 33, INSERT --OF SAID-- BETWEEN "FACE" AND "ENDLESS".

UNITED STATES PATENT AND TRADEMARK OFFICE

CERTIFICATE OF CORRECTION

PATENT NO. : 5,133,156

DATED : July 28, 1992

INVENTOR(S) : Thomas H. Arms, et al.

It is certified that error appears in the above-indentified patent and that said Letters Patent is hereby corrected as shown below:

Column 10, line 32, delete "to" and insert --for--.

Signed and Sealed this

Nineteenth Day of October, 1993

*Attest:*

*Attesting Officer*

BRUCE LEHMAN

*Commissioner of Patents and Trademarks*